US011143121B2

(12) United States Patent
Yonezawa et al.

(10) Patent No.: US 11,143,121 B2
(45) Date of Patent: Oct. 12, 2021

(54) HYBRID VEHICLE AND METHOD OF CONTROLLING THE SAME

(71) Applicant: TOYOTA JIDOSHA KABUSHIKI KAISHA, Toyota (JP)

(72) Inventors: Koichi Yonezawa, Toyota (JP); Satoshi Yoshizaki, Gotenba (JP); Osamu Maeda, Toyota (JP); Daigo Ando, Nagoya (JP); Yoshikazu Asami, Gotenba (JP); Kenji Itagaki, Shizuoka-ken (JP); Shunsuke Oyama, Nagakute (JP); Koichiro Muta, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/865,598

(22) Filed: May 4, 2020

(65) Prior Publication Data

US 2020/0370484 A1 Nov. 26, 2020

(30) Foreign Application Priority Data

May 21, 2019 (JP) ..... JP2019-095136

(51) Int. Cl.
*F02D 41/00* (2006.01)
*F02P 5/15* (2006.01)
*F02P 5/145* (2006.01)

(52) U.S. Cl.
CPC ..... *F02D 41/0007* (2013.01); *F02P 5/145* (2013.01); *F02D 2041/001* (2013.01); *F02D 2200/04* (2013.01); *F02D 2200/0602* (2013.01); *F02D 2250/24* (2013.01)

(58) Field of Classification Search
CPC ..... F02D 41/005; F02D 41/007; F02D 2041/001; F02D 2200/0602; F02D 2250/24; F02P 5/1504
USPC ..... 701/103, 104, 110; 123/320, 324, 325; 180/65.28, 65.31
See application file for complete search history.

(56) References Cited

U.S. PATENT DOCUMENTS 6,273,060 B1 * 8/2001 Cullen ..... F02D 43/00 123/325
2011/0257870 A1 * 10/2011 Nishioka ..... F02D 41/0002 701/104

(Continued)

FOREIGN PATENT DOCUMENTS

JP 2015-058924 A 3/2015

*Primary Examiner* — Erick R Solis
(74) *Attorney, Agent, or Firm* — Sughrue Mion, PLLC

(57) ABSTRACT

A vehicle includes an engine including an injector of cylinder injection type and a forced induction device, a second motor generator that generates electric power with an output torque of the engine, and an ECU that controls the engine and the second motor generator. When an amount of intake air and a fuel pressure of the engine decrease in boosting of suctioned air by the forced induction device, the ECU reduces a decrease in the amount of intake air during a period in which an injection amount is equal to a minimum injection amount, and when an excessive torque is generated in the output torque of the engine along with reducing a decrease in the amount of intake air, the ECU absorbs the excessive torque by a power generation operation of the second motor generator.

8 Claims, 7 Drawing Sheets

(56) References Cited

U.S. PATENT DOCUMENTS

| | | | | |
|---|---|---|---|---|
| 2015/0136076 | A1* | 5/2015 | Styles | F02D 41/042<br>123/325 |
| 2016/0230680 | A1* | 8/2016 | DeMarco | F02P 5/1504 |
| 2016/0319758 | A1* | 11/2016 | Pallett | F02D 41/123 |

* cited by examiner

HYBRID VEHICLE AND METHOD OF CONTROLLING THE SAME

This nonprovisional application is based on Japanese Patent Application No. 2019-095136 filed on May 21, 2019 with the Japan Patent Office, the entire contents of which are hereby incorporated by reference.

BACKGROUND

Field

The present disclosure relates to a hybrid vehicle and a method of controlling the same, and more particularly, to a hybrid vehicle including a forced induction device and a method of controlling the same.

Description of the Background Art

In recent years, the introduction of an engine with a forced induction device has progressed. Increasing torque in a low-rotation area by the forced induction device can decrease displacement while maintaining equivalent power, thus improving, fuel consumption of a vehicle. For example, the hybrid vehicle disclosed in Japanese Patent Laying-Open No. 2015-58924 includes an engine with a turbo forced induction device, and a motor generator.

SUMMARY

In some hybrid vehicles, a fuel injection device that injects fuel into a cylinder is provided in an engine. In such a hybrid vehicle including the engine including the fuel, injection device of in-cylinder injection type and a forced induction device, when the load of the engine rapidly decreases from high load to low load (e.g., during rapid deceleration of a vehicle), an amount of intake air to the cylinder rapidly decreases, and also, a target fuel pressure rapidly decreases. Even when the target fuel pressure rapidly decreases, however, an actual fuel pressure does not decrease unless fuel is injected.

The fuel injection amount includes a minimum injection amount that can secure the accuracy thereof. During a period until the actual fuel pressure decreases to the target fuel pressure, fuel is injected with a requested fuel injection amount being set to the minimum injection amount. In other words, during this period, the fuel injection amount becomes excessive with respect to an optimum injection amount (an injection amount with which an ideal air-fuel ratio is provided), resulting in an over-rich air-fuel ratio. This may lead to deterioration of emission or an accidental fire.

In the hybrid vehicle including an engine including a forced induction device, a period during which the engine is operated at high load is longer or a frequency of such an operation is higher than in a hybrid vehicle including an engine including no forced induction, device, and thus, the above problem may particularly become conspicuous.

The present disclosure has been made to solve the above problem, and an object of the present disclosure is to reduce an over-rich air-fuel ratio in a hybrid vehicle including a forced induction device.

(1) A hybrid vehicle according to an aspect of the present disclosure includes an engine including a fuel injection device of cylinder injection type and a forced induction device, a rotating electric machine that generates electric power with an output torque of the engine, and a controller that controls the engine and the rotating electric machine.

When an amount of intake air of the engine decreases and a fuel pressure of the fuel injection device decreases in boosting of suctioned air by the forced induction device, the controller reduces a decrease in the amount of intake air during a period in which an injection amount of the fuel injection device is equal to a minimum injection amount, and when an excessive torque is generated in the output torque of the engine along with reducing a decrease in the amount of intake air, the controller absorbs the excessive torque by a power generation operation of the rotating electric machine.

(2) The controller sets an upper limit of a decrease rate of the amount of intake air to reduce a decrease in the amount of intake air during the period.

(3) The controller sets a lower limit of the amount of intake air to cause the period to be shorter than a prescribed period.

(4) The controller reduces a decrease in the amount of intake air by control of the forced induction device.

(5) The engine further includes a throttle valve that regulates a flow rate of air introduced from an intake air passage of the engine. The controller reduces a decrease in the amount of intake air by control of the throttle valve.

(6) The engine further includes a variable valve timing device that adjusts a valve timing of the engine. The controller reduces a decrease in the amount of intake air by control of the variable valve timing device.

(7) The engine further includes a variable valve timing device that adjusts a valve timing of the engine. When the excessive torque is generated, the controller decreases the excessive torque by controlling the variable valve timing device such that an ignition timing of the engine is advanced or retarded with respect to a minimum advance for the best torque (MBT).

In (1) to (7) above, when an amount of intake air rapidly decreases upon, for example, rapid deceleration of the hybrid vehicle in boosting of suctioned air by the forced induction device, a decrease in amount of intake air is reduced. This leads to a smaller extent of decrease in the target fuel pressure of the fuel injection device, which is associated with a decrease in amount of intake air, allowing a fuel pressure to rapidly decrease to the target fuel pressure (which will be described below in detail). This leads to an excessive fuel injection amount, reducing a period in which an over-rich air-fuel ratio is provided. With (1) to (7) above, an over-rich air-fuel ratio can thus be reduced.

(8) In a method of controlling a hybrid vehicle according to another aspect of the present disclosure, the hybrid vehicle includes an engine including a fuel injection device of cylinder injection type and a forced induction device, and a rotating electric machine that generates electric power with an output torque of the engine. The method includes: when an amount of intake air of the engine decreases and a fuel pressure of the fuel injection device decreases in boosting of suctioned air by the forced induction device, reducing a decrease in the amount of intake air during a period in which an injection amount of the fuel injection device is equal to a minimum injection amount; and when an excessive torque is generated in the output torque of the engine along with reducing a decrease in the amount of intake air, absorbing the excessive torque by a power generation operation of the rotating electric machine.

The method of (8) above can reduce an over-rich air-fuel ratio as in the configuration of (1) above.

The foregoing and other objects, features, aspects and advantages of the present disclosure will become more apparent from the following detailed description of the present disclosure when taken in conjunction with the accompanying drawings.

DESCRIPTION OF THE PREFERRED EMBODIMENTS

Figure 1:
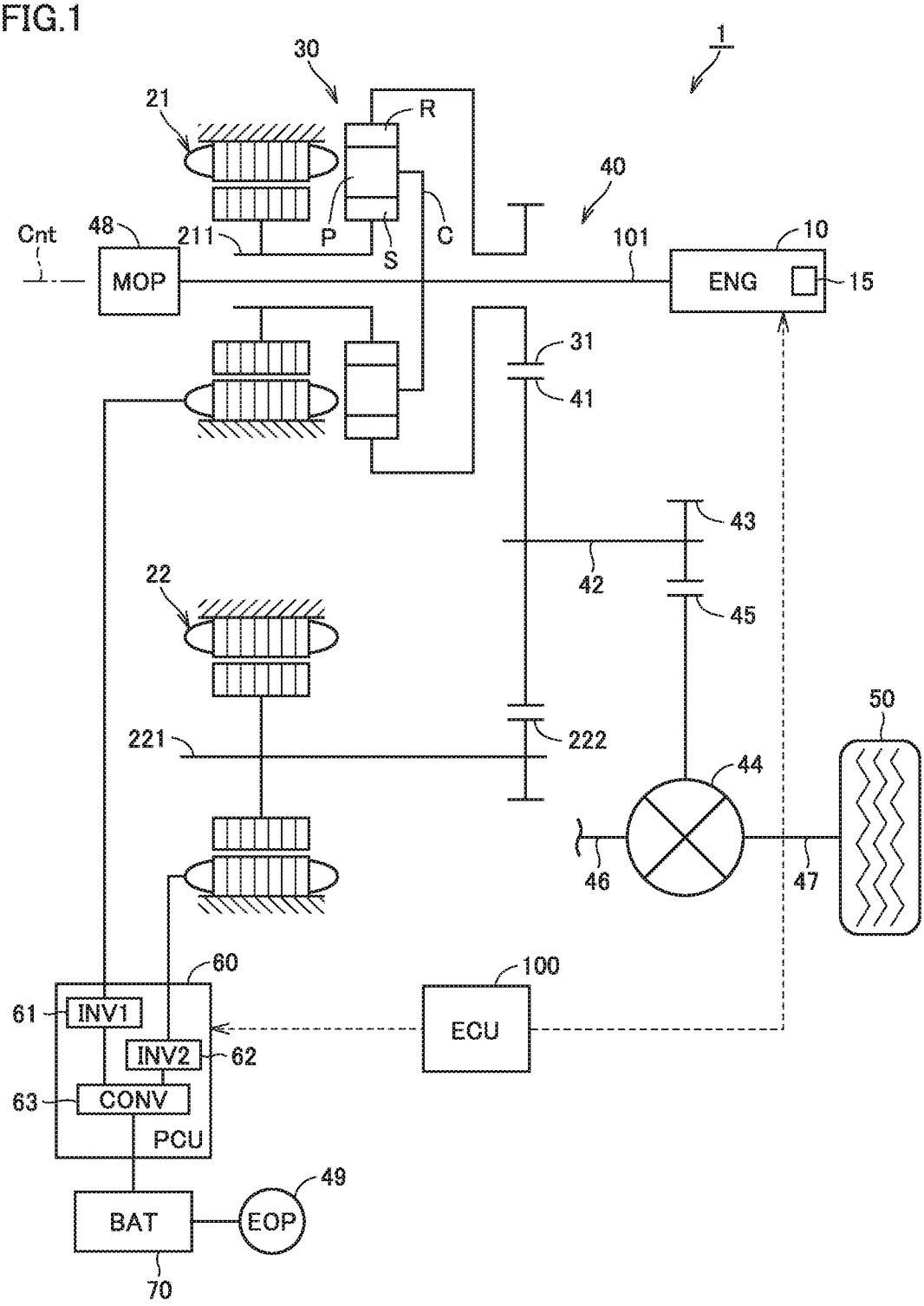
FIG. 1 shows a general configuration of a hybrid vehicle according to an embodiment of the present disclosure.

The present embodiment will now be described in detail with reference to the drawings. The same or corresponding elements will be designated by the same reference numerals in the drawings, the description of which will not be repeated.

Embodiment

<Configuration of Hybrid Vehicle>

FIG. 1 shows a general configuration of a hybrid vehicle according to an embodiment of the present disclosure. Referring to FIG. 1, a vehicle 1 is a hybrid vehicle and includes an engine 10, a first motor generator 21, a second motor generator 22, a planetary gear mechanism 30, a drive device 40, a driving wheel 50, a power control unit (PCU) 60, a battery 70, and an electronic control unit (ECU) 100.

Engine 10 is an engine, such as a gasoline engine. Engine 10 generates motive power for vehicle 1 to travel in accordance with a control signal from ECU 100.

Each of first motor generator 21 and second motor generator 22 is a permanent magnet synchronous motor or an induction motor. First motor generator 21 and second motor generator 22 have rotor shafts 211 and 221, respectively.

First motor generator 21 uses the electric power of battery 70 to rotate a crankshaft (not shown) of engine 10 at startup of engine 10. First motor generator 21 can also use the motive power of engine 10 to generate electric power. Alternating current (AC) power generated by first motor generator 21 is converted into direct current (DC) power by PCU 60, with which charge battery 70 is charged. AC power generated by first motor generator 21 may also be supplied to second motor generator 22.

Second motor generator 22 uses at least one of the electric power from battery 70 and the electric power generated by first motor generator 21 to rotate drive shafts 46 and 47 (which will be described below). Second motor generator 22 can also generate electric power by regenerative braking. AC power generated by second motor generator 22 is converted into DC power by PCU 60, with which battery 70 is charged. Second motor generator 22 corresponds to the "rotating electric machine" according to the present disclosure.

Planetary gear mechanism 30 is a single-pinion planetary gear mechanism and is arranged on an axis Cnt coaxial with an output shaft 101 of engine 10. Planetary gear mechanism 30 transmits a torque output from engine 10 while dividing the torque to first motor generator 21 and an output gear 31. Planetary gear mechanism 30 includes a sun gear S, a ring gear R, pinion gears P, and a carrier C.

Ring gear R is arranged coaxially with sun gear S. Pinion gears P mesh with sun gear S and ring gear R. Carrier C holds pinion gears P in a rotatable and revolvable manner. Each of engine 10 and first motor generator 21 is mechanically coupled to driving wheel 50 with planetary gear mechanism 30 therebetween. Output shaft 101 of engine 10 is coupled to carrier C. Rotor shaft 211 of first motor generator 21 is coupled to sun gear S. Ring gear R is coupled to output gear 31.

In planetary gear mechanism 30, carrier C functions as an input element, ring gear R functions as an output element, and sun gear S functions as a reaction force element. Carrier C receives a torque output from engine 10. Planetary gear mechanism 30 transmits a torque output from engine 10 to output shaft 101 while dividing the torque to sun gear S (and also first motor generator 21) and ring gear R (and also output gear 31). A reaction torque generated by first motor generator 21 acts on sun gear S. Ring gear R outputs a torque to output gear 31.

Drive device 40 includes a driven gear 41, a countershaft 42, a drive gear 43, and a differential gear 44. Differential gear 44 corresponds to a final reduction gear and has a ring gear 45. Drive device 40 further includes drive shafts 46 and 47, an oil pump 48, and an electric oil pump 49.

Driven gear 41 is meshed with output gear 31 coupled to ring gear R of planetary gear mechanism 30. Driven gear 41 is also meshed with a drive gear 222 attached to rotor shaft 221 of second motor generator 22. Countershaft 42 is attached to driven gear 41 and is arranged in parallel with axis Cut. Drive gear 43 is attached to countershaft 42 and is meshed with ring gear 45 of differential gear 44. In drive device 40 having the configuration described above, driven gear 41 operates to combine a torque output from second motor generator 22 to rotor shaft 221 and a torque output from ring gear R included in planetary gear mechanism 30 to output gear 31. A resultant drive torque is transmitted to driving wheel 50 through drive shafts 46 and 47 extending laterally from differential gear 44.

Oil pump 48 is, for example, a mechanical oil pump. Oil pump 48 is provided coaxially with output shaft 101 of engine 10 and is driven by engine 10. Oil pump 48 feeds a lubricant to planetary gear mechanism 30, first, motor generator 21, second motor generator 22, and differential gear 44 during activation of engine 10.

Electric oil pump 49 is driven by electric power supplied from battery 70 or another vehicle-mounted battery (e.g., auxiliary battery), which is not shown. Electric oil pump 49 feeds a lubricant to planetary gear mechanism 30, first motor generator 21, second motor generator 22, and differential gear 44 while engine 10 is at rest.

PCU 60 converts DC power stored in battery 70 into AC power and supplies the AC power to first motor generator 21 and second motor generator 22, in response to a control signal from ECU 100. PCU 60 also converts AC power generated by first motor generator 21 and second motor generator 22 into DC power and supplies the DC power to battery 70. PCU 60 includes a first inverter 61, a second inverter 62, and a converter 63.

First inverter 61 converts a DC voltage into an AC voltage and drives first motor generator 21, in response to a control signal from ECU 100. Second inverter 62 converts a DC voltage into an AC voltage and drives second motor generator 22, in response to a control signal from ECU 100. Converter 63 steps up a voltage supplied from battery 70 and supplies the voltage to first inverter 61 and second inverter 62, in response to a control signal from ECU 100. Converter 63 also steps down a DC voltage from either one or both of first inverter 61 and second inverter 62 and charges battery 70, in response to a control signal from ECU 100.

Battery 70 includes a secondary battery, such as a lithium ion secondary battery or a nickel-hydrogen battery. The battery may be a capacitor, such as an electric double layer capacitor.

ECU 100 is composed of, for example, a central processing unit (CPU), a memory. I/O ports, and a counter, all of which are not shown. The CPU executes a control program. The memory stores, for example, various control programs and maps. The I/O ports control the transmission and reception of various signals. The counter counts a time. ECU 100 outputs a control signal and controls various devices such that vehicle 1 enters the desired state, based on a signal input from each sensor (described below), and the control program and map stored in the memory.

<Configuration of Engine>

Figure 2:
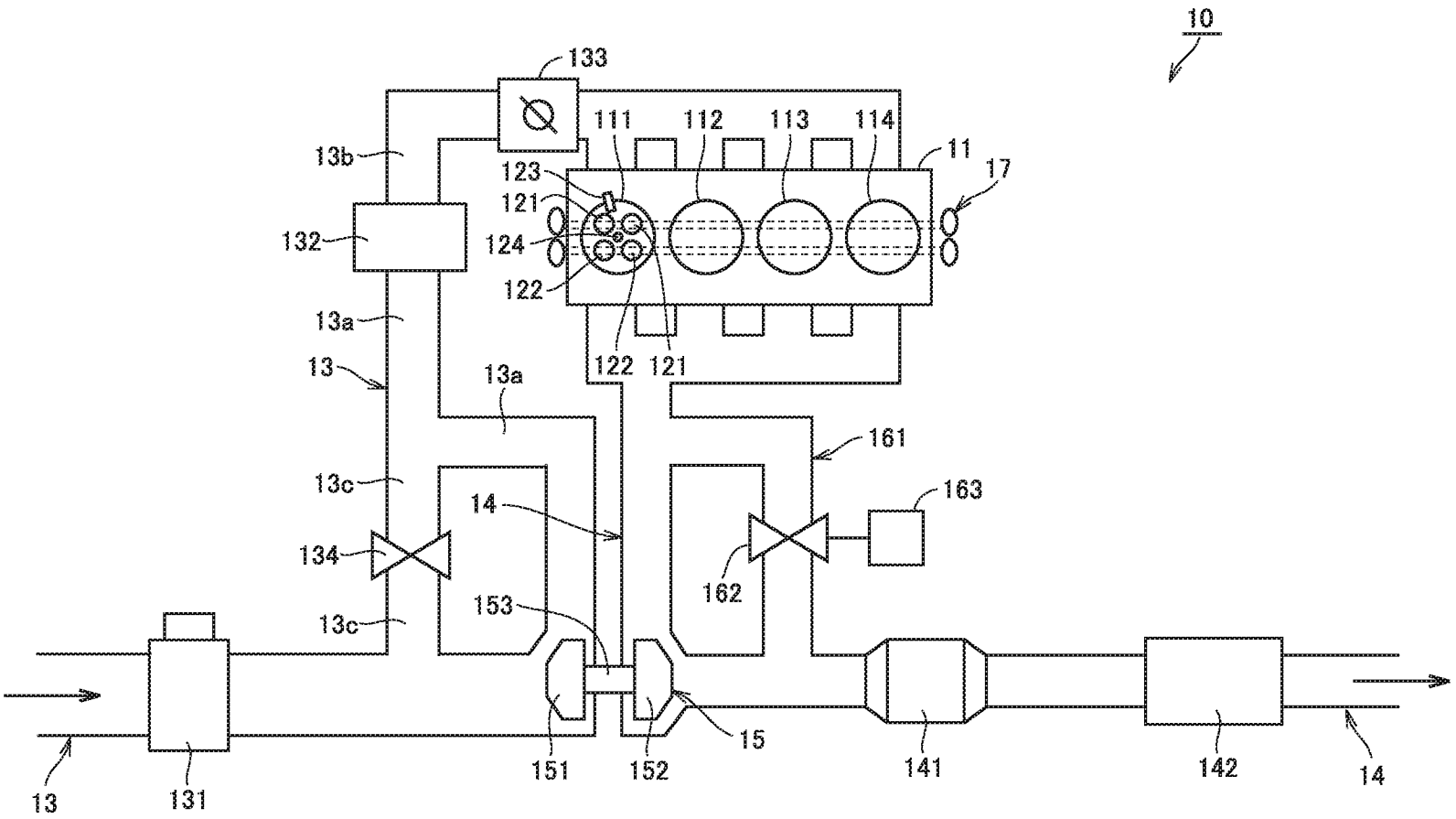
FIG. 2 shows an example configuration of an intake and exhaust system of an engine in the present embodiment.

FIG. 2 shows an example configuration of an intake and exhaust system of engine 10 in the present embodiment. Referring to FIG. 2, engine 10 is, for example, an in-line four-cylinder spark ignition internal combustion engine. Engine 10 includes an engine main body 11. Engine main body 11 includes four cylinders 111 to 114. Four cylinders 111 to 114 are aligned in one direction. Since cylinders 111 to 114 have an equivalent configuration, the configuration of cylinder 111 will be representatively described below.

Cylinder 111 is provided with two intake valves 121, two exhaust valves 122, an injector 123, and an ignition plug 124. Cylinder 111 is connected with an intake air passage 13 and an exhaust passage 14. Intake air passage 13 is opened and closed by intake valves 121. Exhaust passage 14 is opened and closed by exhaust valves 122.

Fuel (e.g., gasoline) is stored while being pressurized in a high-pressure delivery pipe (not shown). When injector 123 (corresponding to the "fuel injection device" according to the present disclosure), which is an in-cylinder injection valve, is opened, the pressurized fuel in the high-pressure delivery pipe is injected within cylinder 111. Also, air is supplied to engine main body 11 through intake air passage 13. Then, the injected fuel and the supplied air are mixed to generate an air-fuel mixture. The generated air-fuel mixture is ignited by ignition plug 124 to be burned. The combustion energy generated through the combustion of the air-fuel mixture is converted into kinetic energy by a piston (not shown) within cylinder 111 and is output to output shaft 101.

Engine 10 further includes a turbo forced induction device 15. In the present embodiment, forced induction device 15 is a turbocharger that uses exhaust energy to boost suctioned air. Forced induction device 15 includes a compressor 151, a turbine 152, and a shaft 153.

Forced induction device 15 uses exhaust energy to rotate turbine 152 and compressor 151, thereby boosting suctioned air (i.e., increasing the density of air suctioned into engine main body 11). More specifically, compressor 151 is disposed in intake air passage 13, and turbine 152 is disposed in exhaust passage 14. Compressor 151 and turbine 152 are coupled to each other with shaft 153 therebetween to rotate together. Turbine 152 rotates by a flow of exhaust discharged from engine main body 11. The rotative force of turbine 152 is transmitted to compressor 151 through shaft 153 to rotate compressor 151. The rotation of compressor 151 compresses intake air that flows toward engine main body 11, and the compressed air is supplied to engine main body 11.

Upstream of compressor 151 in intake air passage 13, an air flow meter 131 is provided. Downstream of compressor 151 in intake air passage 13, an intercooler 132 is provided. Downstream of intercooler 132 in intake air passage 13, a throttle valve (intake throttle valve) 133 is provided. Thus, air that flows into intake air passage 13 is supplied to each of cylinders 111 to 114 of engine main body 11 through air flow meter 131, compressor 151, intercooler 132, and throttle valve 133 in the stated order.

Air flow meter 131 outputs a signal corresponding to a flow rate of air that flows through intake air passage 13. Intercooler 132 cools intake air compressed by compressor 151. Throttle valve 133 can regulate a flow rate of intake air that flows through intake air passage 13.

Downstream of turbine 152 in exhaust passage 14, a start-up catalyst converter 141 and an aftertreatment device 142 are provided. Further, exhaust passage 14 is provided with a waste gate valve (WGV) device 16. WGV device 16 can flow exhaust discharged from engine main body 11 while diverting the exhaust around turbine 152 and regulate the amount of exhaust to be diverted. WGV device 16 includes a bypass passage 161, a WGV 162, and a WGV actuator 163.

Bypass passage 161 is connected to exhaust passage 14 and flows exhaust while diverting the exhaust around turbine 152. Specifically, bypass passage 161 is branched from a portion upstream of turbine 152 in exhaust passage 14 (e.g., between engine main body 11 and turbine 152) and meets a portion downstream of turbine 152 in exhaust passage 14 (e.g., between turbine 152 and start-up catalyst converter 141).

WGV 162 is disposed in bypass passage 161. WGV 162 can regulate a flow rate of exhaust guided from engine main body 11 to bypass passage 161 depending on its opening. As WGV 162 is closed by a larger amount, the flow rate of exhaust guided from engine main body 11 to bypass passage 161 decreases, whereas the flow rate of exhaust that flows into turbine 152 increases, leading to a higher pressure of suctioned air (i.e., boost pressure).

WGV actuator 163 regulates an opening of WGV 162 in accordance with control of ECU 10. WGV actuator 163 may be a negative-pressure actuator that exerts a negative pressure on one side of a diaphragm (not shown) or an electric actuator that electrically drives WGV 162.

Exhaust discharged from engine main body 11 passes through any one of turbine 152 and WGV 162. Each of start-up catalyst converter 141 and aftertreatment device 142 includes, for example, a three-way catalyst and removes a hazardous substance in the exhaust. More specifically, since start-up catalyst converter 141 is provided at an upstream portion (a portion close to the combustion chamber) of exhaust passage 14, its temperature rises to the activation temperature in a short period of time after startup of engine 10. Aftertreatment device 142 located downstream purifies HC, CO, and NOx that were not purified by start-up catalyst converter 141.

Engine 10 further includes a variable valve timing (VVT) mechanism 17. VVT mechanism 17 is a hydraulic or electric mechanism and can adjust operating characteristics (valve timing) of intake valve 121. VVT mechanism 17 includes camshafts (an intake-side camshaft and an exhaust-side camshaft), and a cam sprocket, which are not shown. When the intake-side camshaft rotates, intake valves 121 provided in each of cylinders 111 to 114 are opened and closed by cams. When the phases of the intake-side camshaft and the cam sprocket change in accordance with control by ECU 100, a timing at which intake valve 121 is opened and a timing at which intake valve 121 is closed change. These timings may change independently of each other or may change together.

Although FIG. 2 shows a configuration in which the fuel supply mode of engine 10 is an in-cylinder injection mode by way of example, the fuel supply mode may use in-cylinder injection and port injection together. Also, although FIG. 2 illustrates an example of the turbo forced induction device that boosts suctioned air with the use of exhaust energy, forced induction device 15 may be such a type of mechanical supercharger that drives a compressor with the use of the rotation of engine 10.

<Configuration of Control System>

Figure 3:
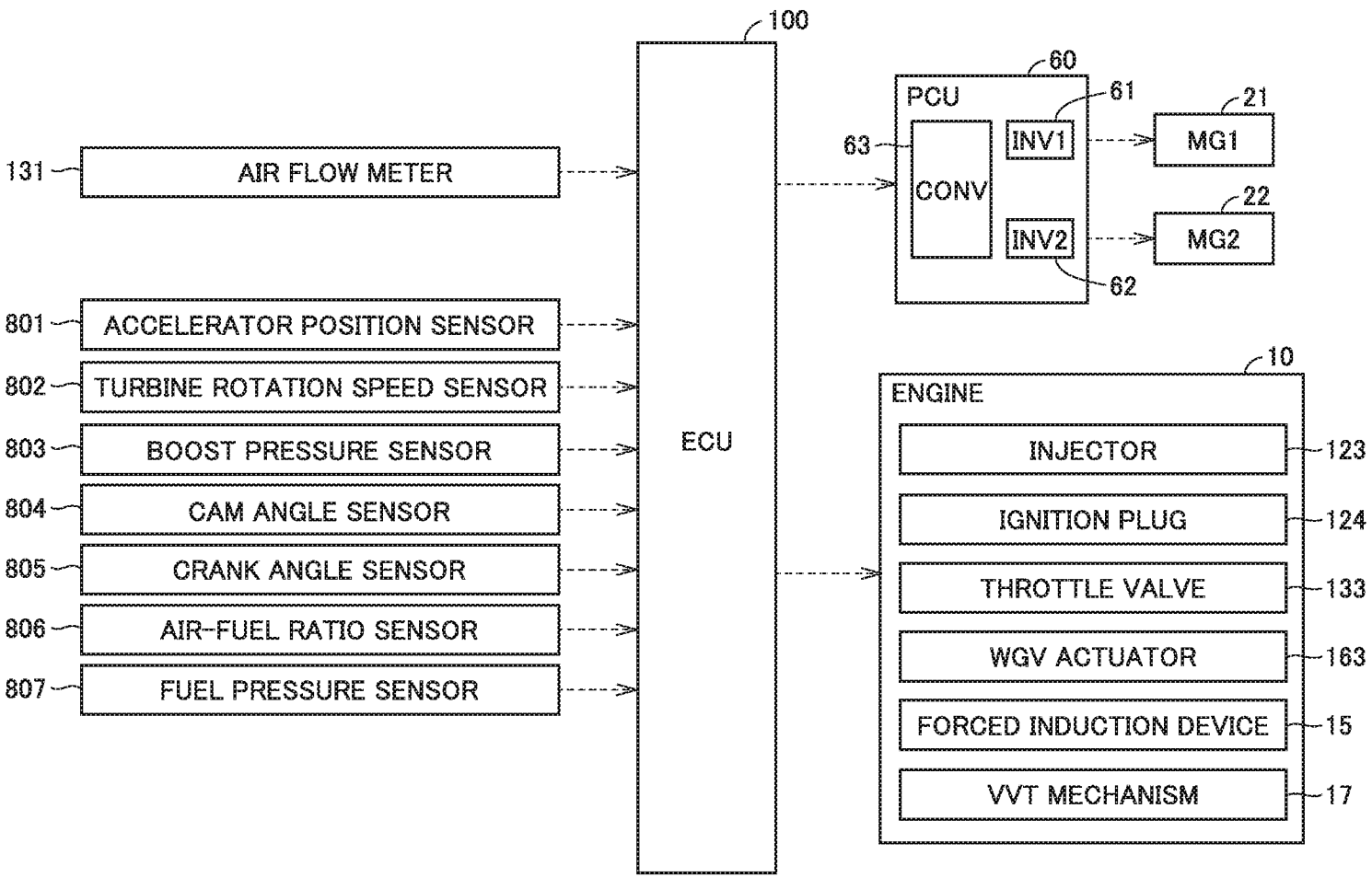
FIG. 3 shows an example configuration of a control system of a hybrid vehicle in the present embodiment.

FIG. 3 shows an example configuration of a control system of vehicle 1 in the present embodiment. Referring to FIG. 3, vehicle 1 further includes an accelerator position sensor 801, a turbine rotation speed sensor 802, a boost pressure sensor 803, a cam angle sensor 804, a crank angle sensor 805, an air-fuel ratio sensor 806, and a fuel pressure sensor 807.

Accelerator position sensor 801 detects an amount of pressing (accelerator position Acc) of an accelerator pedal (not shown) by the user. Turbine rotation speed sensor 802 detects a rotation speed of turbine 152 of forced induction device 15. Boost pressure sensor 803 is provided upstream of intercooler 132 and detects a boost pressure by forced induction device 15. Cam angle sensor 804 detects a position of a cam provided in the intake-side camshaft and a position of a cam provided in the exhaust-side camshaft. Crank angle sensor 805 detects a rotation speed (i.e., engine rotation speed Ne) of the crankshaft and a rotation angle (crank angle) of the crankshaft. Air-fuel ratio sensor 806 detects a concentration of oxygen (the air-fuel ratio of the air-fuel mixture) being emitted. Fuel pressure sensor 807 detects a pressure of fuel in the high-pressure delivery pipe (hereinafter, referred to as "fuel pressure epr"). Each sensor outputs a signal indicating a result of the detection to ECU 100.

ECU 100 cooperatively controls engine 10, first motor generator 21, and second motor generator 22 (cooperative control). First, ECU 100 determines a requested driving force in accordance with, for example, an accelerator position and a vehicle speed and calculates requested power of engine 10 from the requested driving force. ECU 100 determines, from the requested power of engine 10, an engine operating point (a combination of engine rotation speed Ne and engine torque Te) at which, for example, the smallest fuel consumption of engine 10 is provided, ECU 100 then generates signals for driving first motor generator 21 and second motor generator 22 to control PCU 60, and also controls each component of engine 10 (e.g., injector 123, ignition plug 124, throttle valve 133, WGV actuator 163, forced induction device 15, VVT mechanism 17).

ECU 100 calculates a target fuel pressure from a map or the like in accordance with the operating state of the engine (e.g., engine rotation speed Ne and load), and feedback-controls an amount of discharge of a high-pressure pump (not shown) so as to cause fuel pressure epr in the high-pressure delivery pipe, detected by fuel pressure sensor 807, to match the target fuel pressure. ECU 100 further calculates a requested injection amount Q of fuel in accordance with the operating state of the engine and calculates an injection time of injector 123 in accordance with requested injection amount Q and fuel pressure epr. ECU 100 then opens injector 123 by an amount of the calculated injection time to inject fuel for the amount of requested injection amount Q.

ECU 100 calculates a target torque of engine 10 in accordance with the operating state of the engine, and further calculates a target intake air amount KL from a target torque TQ. ECU 100 then feedback-controls an opening (intake air pressure Pm) of throttle valve 133, a boost pressure of forced induction device 15, and a phase of VVT mechanism 17 such that the amount of intake air of engine 10 matches target intake air amount KL.

ECU 100 may be configured separately as two or three ECUs (e.g., an ECU that controls the engine, an ECU that controls PCU 60) by function.

<Fuel Pressure, Minimum Injection Amount, and Target Intake Air Amount>

Figure 4:
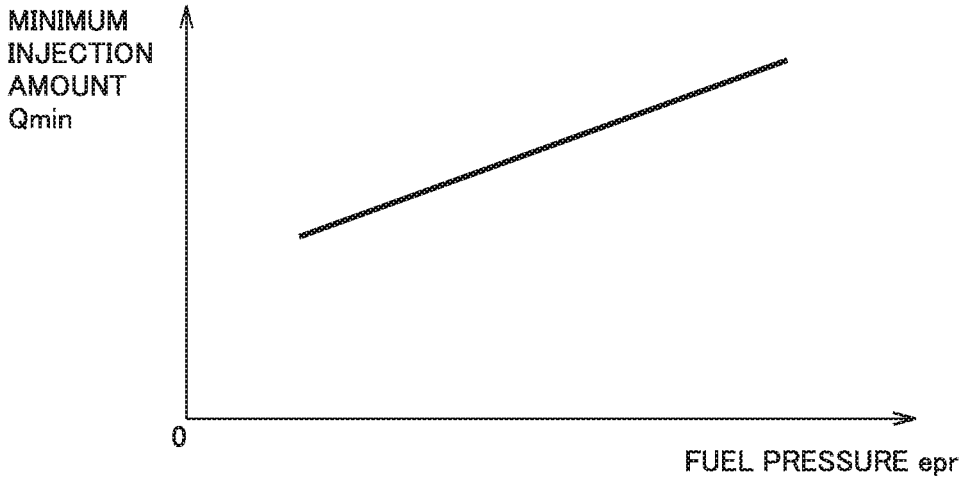
FIG. 4 is a diagram for illustrating a relationship between fuel pressure and minimum injection amount.

FIG. 4 is a diagram for illustrating a relationship between fuel pressure epr and minimum injection amount Qmin. In FIG. 4, the horizontal axis represents fuel pressure epr in the high-pressure delivery pipe, and the vertical axis represents minimum injection amount Qmin from injector 123. Minimum injection amount Qmin is a minimum injection amount that guarantees linearity in the relationship between an injection time and an injection amount of injector 123. As shown in FIG. 4, minimum injection amount Qmin increases as fuel pressure epr is higher. Control of target intake air amount KL in a comparative example will be described first for easy understanding of control of target intake air amount KL in the present embodiment.

Figure 5:
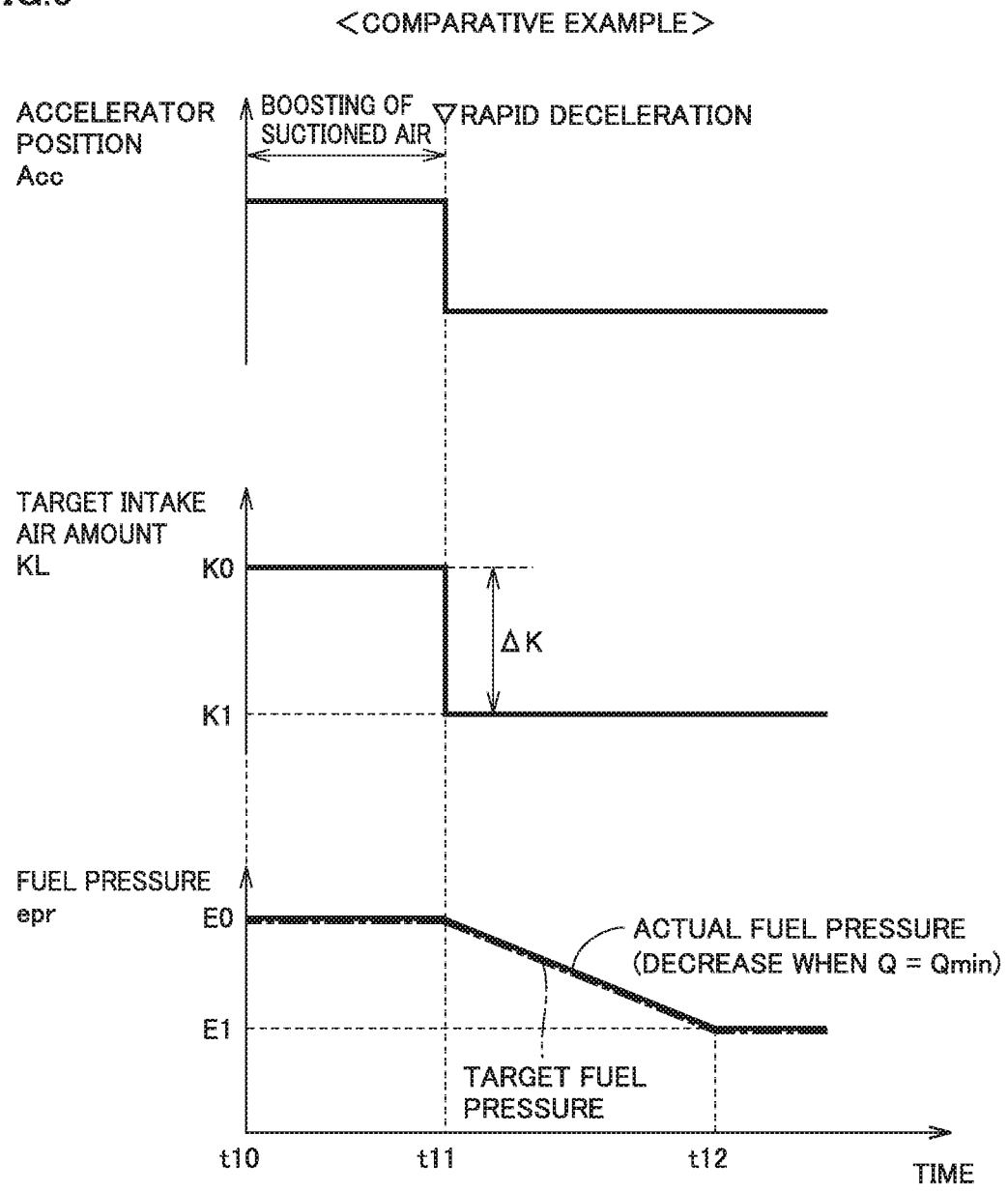
FIG. 5 is a time chart showing example changes in target intake air amount and fuel pressure in a comparative example.
Figure 6:
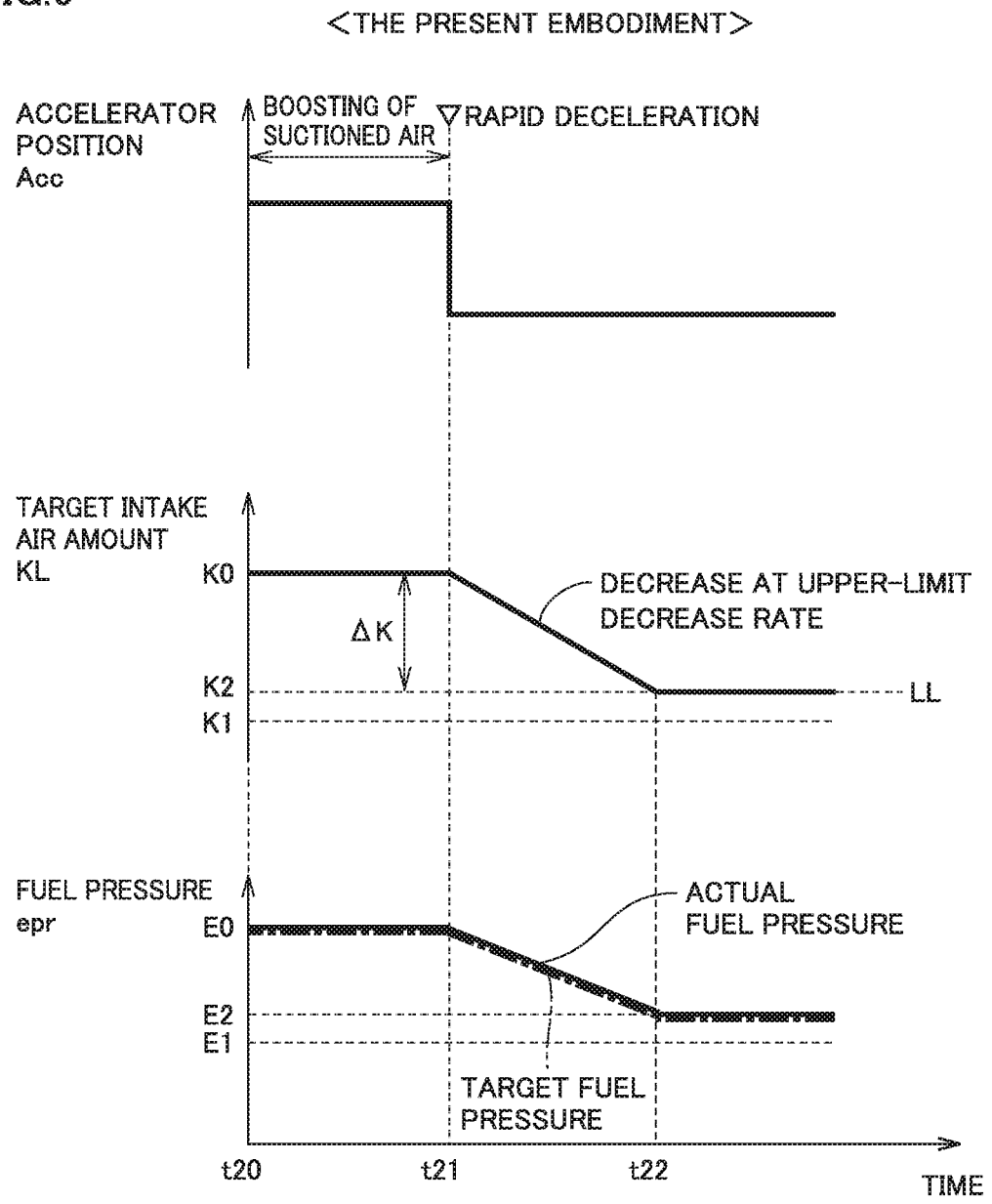
FIG. 6 is a time chart for illustrating target intake air amount control in the present embodiment.

FIG. 5 is a time chart showing example changes in target intake air amount KL and fuel pressure epr in the comparative example. In FIG. 5 and FIG. 6, which will be described below, the horizontal axis represents an elapsed time, and the vertical axis represents accelerator position Ace, target intake air amount KL of engine 10, and fuel pressure epr in the high-pressure delivery pipe in order from the top. As described below, target intake air amount KL is calculated from target torque TQ, and accordingly, target intake air amount KL of the vertical axis may be read as target torque TQ.

Referring to FIG. 5, it is supposed that at an early time t10, engine 10 operates at high load while operating forced induction device 15. Target intake air amount KL is K0 at this time. Vehicle 1 rapidly decelerates at a time t11, and the load (which may be target torque TQ) of vehicle 1 rapidly decreases from high load to low load. Then, target intake air amount KL decreases from K0 to K1. When forced induction device 15 has been operating before the rapid deceleration, target intake air amount K0 is large, and accordingly, an extent of decrease ΔK (=K0−K1) of the target intake air amount is also large.

Along with the rapid deceleration of vehicle 1, the target fuel pressure decreases from E0 to E1 along with the rapid deceleration of target intake air amount KL. However, actual fuel pressure epr will not decrease unless fuel stored in the high-pressure delivery pipe is not injected actually. In other words, it takes time for fuel pressure epr to decrease. The target fuel pressure is set in accordance with a decrease rate of fuel pressure epr.

As described with reference to FIG. 4, the fuel injection amount includes minimum injection amount Qmin that can secure the accuracy thereof. During a period in which fuel pressure epr decreases from E0 to E1 (a period from time t11 to time t12), fuel is injected from injector 123 with requested injection amount Q set to minimum injection amount Qmin. During this period, the fuel injection amount becomes excessive with respect to an optimum injection amount (an injection amount with which an ideal air-fuel ratio is provided), leading to an over-rich air-fuel ratio. This may lead to deterioration of emission or an accidental fire.

When forced induction device 15 boosts suctioned air, engine 10 is more likely to be operated with higher target intake air amount KL than when forced induction device 15 does not boost suctioned air. When target intake air amount KL is higher, extent of decrease ΔK of the target intake air amount along with the rapid deceleration of vehicle 1 is more likely to increase correspondingly. In vehicle 1, which includes engine 10 including forced induction device 15, the above problem of over-rich air-fuel ratio can become particularly conspicuous compared with a hybrid vehicle including an engine including no forced induction device.

In the present embodiment, thus, a "lower-limit intake air amount KL0", which is a lower limit of target intake air amount KL, is set first, and when target intake air amount KL decreases and fuel pressure epr decreases in boosting of suctioned air by forced induction device 15 along with the rapid deceleration or the like of vehicle 1, lower-limit intake air amount KLmin is set to be large such that a period in which requested injection amount Q is equal to minimum injection amount Qmin is shorter than a prescribed period. This control is referred to as "target intake air amount control" and will be described below in detail.

<Target Intake Air Amount Control>

FIG. 6 is a time chart for illustrating target intake air amount control in the present embodiment. Referring to FIG. 6, in the present embodiment, a lower-limit intake air amount LL is set, and target intake air amount KL only decreases to lower-limit intake air amount LL. In the example shown in FIG. 6, though target intake air amount KL decreases from K0 to K2 at a time t21 along with rapid deceleration of vehicle 1, a decrease in target intake air amount KL below lower-limit intake air amount LL is prohibited, and thus, target intake air amount KL=K2 is equal to lower-limit intake air amount LL at this time, Lower-limit intake air amount LL is higher than K1 (indicated by the broken line also in FIG. 6) in the comparative example. Lower-limit intake air amount LL is set such that a period in which requested injection amount Q is equal to minimum injection amount Qmin is shorter than a prescribed period.

In the example shown in FIG. 6, the target fuel pressure decreases from E0 to E2. An extent of decrease ΔK (=K0−K2) in target intake air amount KL is smaller than extent of decrease ΔK (=K0−K1) in target intake air amount KL in the comparative example, and accordingly, an extent of decrease (=E0−E2) in target fuel pressure is also small. Thus, a period in which fuel pressure epr decreases from E0 to E2 (a period from time t21 to time t22) also decreases. Consequently, the fuel injection amount becomes excessive with respect to an optimum injection amount, leading to a short period in which an over-rich air-fuel ratio is provided. This can reduce an over-rich air-fuel ratio to reduce a risk of deterioration of emission or an accidental fire.

In the present embodiment, further, an upper limit is placed to the decrease rate (an amount of decrease per unit time) of target intake air amount KL. Thus, target intake air amount KL decreases moderately at the upper-limit decrease rate during a period in which fuel pressure epr decreases from E0 to E2. The upper-limit decrease rate is determined such that, for example, target intake air amount KL decrease from K0 to K2 at a constant rate during a period in which fuel pressure epr decreases from E0 to E2. Through moderate decrease in target intake air amount KL, air as much as possible is supplied to cylinders 111 to 114 also during the period in which fuel pressure epr decreases from E0 to E2. This can also reduce an over-rich air-fuel ratio to reduce a risk of deterioration of emission or an accidental fire.

<Control Flow>

Figure 7:
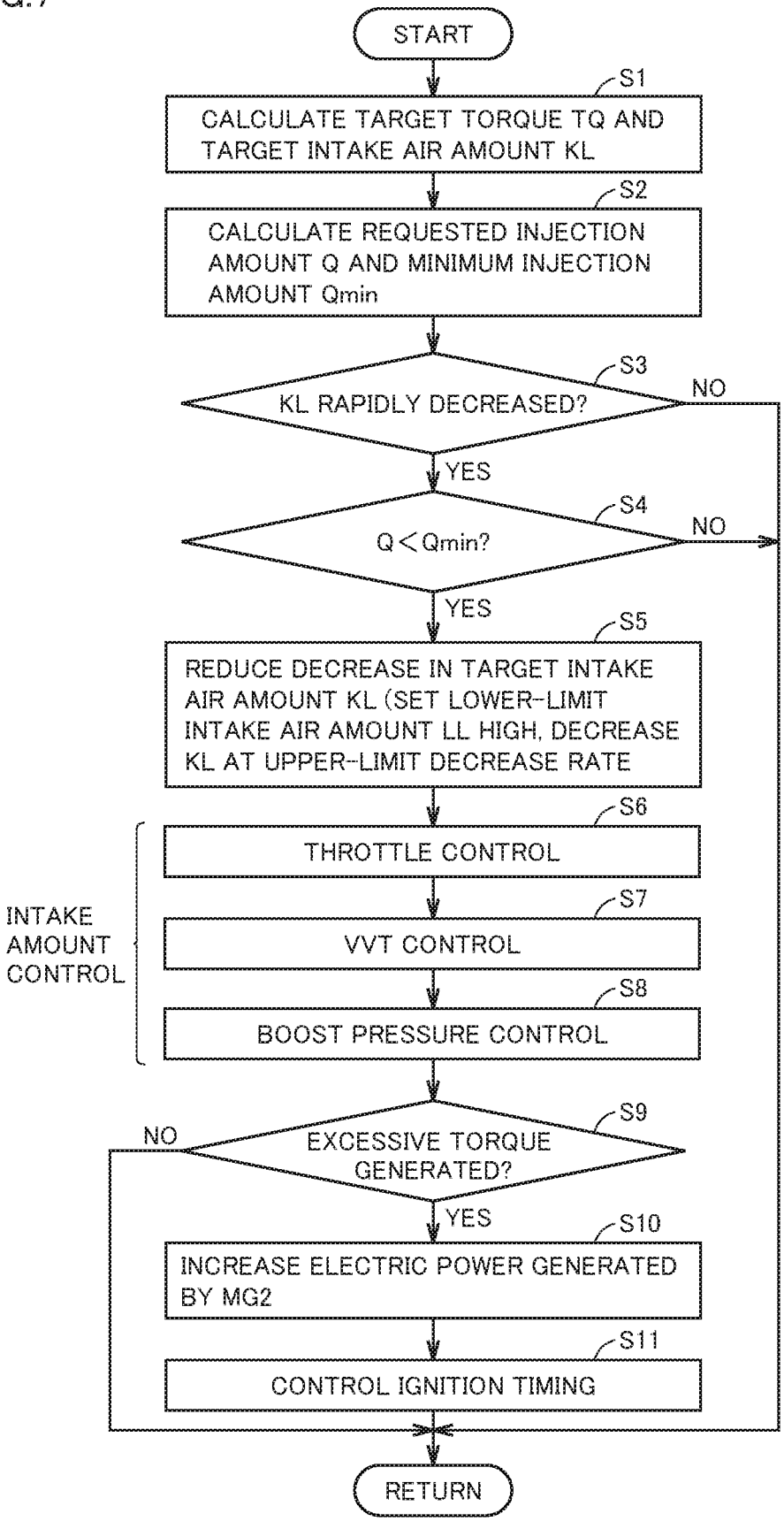
FIG. 7 is a flowchart for illustrating target intake air amount control in the present embodiment.

FIG. 7 is a flowchart for illustrating target intake air amount control in the present embodiment. A series of processes shown in this flowchart are repeatedly performed for each predetermined control cycle in ECU 100 in boosting of suctioned air by forced induction device 15. Each step (hereinafter abbreviated as "S") is basically implemented through a software process by ECU 100, which may be implemented through a hardware process by an electronic circuit fabricated in ECU 100.

Referring to FIG. 7, at S1, ECU 100 calculates target torque TQ of vehicle 1 based on accelerator position Acc detected by accelerator position sensor 801. ECU 100 further refers to a map (not shown), in which the relationship between target torque TQ and target intake air amount KL is defined in advance, to calculate target intake air amount KL from target torque TQ.

At S2, ECU 100 uses, for example, target intake air amount KL and various conversion coefficients and correction coefficients to calculate requested injection amount Q of injector 123. The conversion coefficients and correction coefficients are appropriately calculated in accordance with a flow rate detected by air flow meter 131, a boost pressure detected by boost pressure sensor 803, an air-fuel ratio detected by air-fuel ratio sensor 806, or the like. ECU 100 may calculate requested injection amount Q with consideration given to an ineffective injection amount, a purge correction amount, or the like of injector 123. ECU 100 further calculates minimum injection amount Qmin of injector 123. With the use of a relational expression in which the relationship between fuel pressure epr and minimum injection amount Qmin is defined as shown in FIG. 4, minimum injection amount Qmin can be calculated from fuel pressure epr detected by fuel pressure sensor 807.

At S3, ECU 100 determines whether target intake air amount KL has rapidly decreased. More specifically, when target intake air amount KL has decreased by a defined amount determined in advance or more during a prescribed period (e.g., during a period of several past control cycles), ECU 100 determines that target intake air amount KL has rapidly decreased. When target intake air amount KL has rapidly decreased (YES at S3), ECU 100 advances the process to S4 to compare requested injection amount Q of injector 123 with minimum injection amount Qmin thereof. When requested injection amount Q is smaller than minimum injection amount Qmin (YES at S4), ECU 100 proceeds the process to S5 to perform target intake air amount control for reducing a decrease in target intake air amount KL.

When target intake air amount KL has not rapidly decreased (NO at S3) or when requested injection amount Q is equal to or greater than minimum injection amount Qmin (NO at S4), ECU 100 does not perform the following processes and returns the process to the main routine. In this case, though not shown, target intake air amount KL is controlled as usual.

At S5, ECU 100 decreases target intake air amount KL at the upper-limit decrease rate and also sets lower-limit intake air amount LL to a value that can reduce an excessive decrease in target intake air amount KL. The upper-limit decrease rate is determined such that, for example, target intake air amount KL decreases at a constant rate during a period in which fuel pressure epr decreases (see FIG. 6). Lower-limit intake air amount LL is preferably set based on the result of an experiment conducted in advance such that a period in which requested injection amount Q is equal to minimum injection amount Qmin is shorter than the prescribed period. In other words, the value of target intake air amount KL that allows requested injection amount Q to attain to minimum injection amount Qmin or more as early as possible is set as lower-limit intake air amount LL. For example, the relationship between fuel pressure epr and lower-limit intake air amount LL, determined by experiment in advance, is stored in a memory (not shown) of ECU 100 as, for example, a map. This allows ECU 100 to refer to the map to set lower-limit intake air amount LL corresponding to fuel pressure epr.

It is not necessarily required to perform both of setting the upper-limit decrease rate of target intake air amount KL and setting lower-limit intake air amount LL of target intake air amount KL in order to reduce an excessive decrease in target intake air amount KL, and any one setting may be performed.

At S6 to S8, subsequently, ECU 100 controls an amount of intake air to intake air passage 13 so as to achieve target intake air amount KL, an excessive decrease of which is reduced, by setting of lower-limit intake air amount LL at S5. More specifically at S6, ECU 100 controls an opening of throttle valve 133 such that a target intake pressure Pm changes to increase an amount of intake air to intake air passage 13 (throttle control). At S7, ECU 100 corrects valve open/close characteristics of VVT mechanism 17 to increase the amount of intake air to intake air passage 13 (VVT control). At S9, further, ECU 100 controls an opening of waste gate valve 162 such that the target boost pressure changes to increase the amount of intake air to intake air passage 13 (boost pressure control). It is not necessarily required for ECU 100 to perform all the processes of S6 to S8, and only one or two processes among the processes of S6 to S8 may be performed.

The execution of the processes of S5 to S8 leads to a smaller extent of decrease in the target fuel pressure (E0-E2 in FIG. 6) than when target intake air amount control is not performed (e.g., in the case where target intake air amount KL and requested injection amount Q decrease by an equal amount when the forced induction device boosts suctioned air). Thus, fuel pressure epr reaches the target fuel pressure early, resulting in a shorter period in which an over-rich air-fuel ratio is provided. On the other hand, the output torque of engine 10 may increase along with reducing a decrease in target intake air amount KL, which may cause an excessive output torque. ECU 100 thus determines whether an excessive torque (an excess of the output torque of engine 10) has occurred (S9). When the output torque calculated from engine rotation speed Ne, intake air amount, or the like is equal to or greater than target torque TQ calculated at S1, ECU 100 determines that an excessive torque has been generated. When the excessive torque has not been generated (NO at S9), the processes of S10 and S11 are skipped.

When an excessive torque has been generated (YES at S9), at S10, ECU 100 controls PCU 60 such that second motor generator 22 performs a power generation operation with the excessive torque, thereby absorbing the excessive torque. In other words, ECU 100 increases regenerative power by second motor generator 22, thereby canceling, an amount of increase in the output torque of engine 10 with an amount of increase in load torque owing to an increase in regenerative power.

At S11, ECU 100 controls VVT mechanism 17 such that, for example, the ignition timing of engine 10 is more retarded with respect to a minimum advance for the best torque (MBT). The output torque of engine 10 can be decreased by retarding the ignition timing, thereby decreasing an excessive torque. The ignition timing is appropriately adjusted in accordance with the MBT, and the ignition timing may be more retarded with respect to the MBT.

It, is not necessarily required to perform both of increasing the regenerative power by second motor generator 22 and adjusting the ignition timing, and an amount of increase in the output torque of engine 10, which is associated with the reduction in a decrease in amount of intake air, may be eliminated only by an amount of increase in load torque, which is caused owing to an increase in regenerative power by second motor generator 22.

In the present embodiment, when target intake air amount KL rapidly decreases due to rapid deceleration of vehicle 1 in boosting of suctioned power by forced induction device 15, lower-limit intake air amount LL is set to a relatively high value to reduce (guard) an excessive decrease in target intake air amount KL, as described above. This decreases an extent of decrease in target fuel pressure, and actual fuel pressure epr decreases to a target pressure early, so that requested injection amount Q exceeds minimum injection amount Qmin at early stage. Consequently, the present embodiment can reduce a period in which a fuel injection amount becomes excessive with respect to an optimum injection amount to provide an over-rich air-fuel ratio. This can reduce a risk of deterioration of emission or an accidental fire.

Although an embodiment of the present disclosure has been described and illustrated in detail, it is clearly understood that the same is by way of illustration and example only and is not to be taken by way of limitation, the scope of the present disclosure being interpreted by the terms of the appended claims.

What is claimed is:

1. A hybrid vehicle comprising:

an engine including a fuel injection device of cylinder injection type and a forced induction device;

a rotating electric machine that generates electric power with an output torque of the engine; and a controller that controls the engine and the rotating electric machine, wherein when an amount of intake air of the engine decreases and a fuel pressure of the fuel injection device decreases in boosting of suctioned air by the forced induction device, the controller reduces a decrease in the amount of intake air during a period in which an injection amount of the fuel injection device is equal to a minimum injection amount, and when an excessive torque is generated in the output torque of the engine along with reducing a decrease in the amount of intake air, the controller absorbs the excessive torque by a power generation operation of the rotating electric machine.

2. The hybrid vehicle according to claim 1, wherein the controller sets an upper limit of a decrease rate of the amount of intake air to reduce a decrease in the amount of intake air during the period.

3. The hybrid vehicle according to claim 1, wherein the controller sets a lower limit of the amount of intake air to cause the period to be shorter than a prescribed period.

4. The hybrid vehicle according to claim 1, wherein the controller reduces a decrease in the amount of intake air by control of the forced induction device.

5. The hybrid vehicle according to claim 1, wherein the engine further includes a throttle valve that regulates a flow rate of air introduced from an intake air passage of the engine, and the controller reduces a decrease in the amount of intake air by control of the throttle valve.

6. The hybrid vehicle according to claim 1, wherein the engine further includes a variable valve timing device that adjusts a valve timing of the engine, and the controller reduces a decrease in the amount of intake air by control of the variable valve timing device.

7. The hybrid vehicle according to claim 1, wherein the engine further includes a variable valve timing device that adjusts a valve timing of the engine, and when the excessive torque is generated, the controller decreases the excessive torque by controlling the variable valve timing device such that an ignition timing of the engine is advanced or retarded with respect to a minimum advance for the best torque (MBT).

8. A method of controlling a hybrid vehicle, the hybrid vehicle including an engine including a fuel injection device of cylinder injection type and a forced induction device, and a rotating electric machine that generates electric power with an output torque of the engine, the method comprising:

when an amount of intake air of the engine decreases and a fuel pressure of the fuel injection device decreases in boosting of suctioned air by the forced induction device, reducing a decrease in the amount of intake air during a period in which an injection amount of the fuel injection device is equal to a minimum injection amount; and when an excessive torque is generated in the output torque of the engine along with reducing a decrease in the amount of intake air, absorbing the excessive torque by a power generation operation of the rotating electric machine.

* * * * *